US006260921B1

(12) United States Patent
Chu et al.

(10) Patent No.: US 6,260,921 B1
(45) Date of Patent: Jul. 17, 2001

(54) LUMBAR SUPPORT ADJUSTMENT MECHANISM

(75) Inventors: Zooey Chu, Grand Rapids, MI (US); Harald Wurl, Kleinsendelbach; Hermann Bock, Pyrbaum, both of (DE)

(73) Assignee: Teknion Furniture Systems, Inc., Downsview (CA)

( * ) Notice: Subject to any disclaimer, the term of this patent is extended or adjusted under 35 U.S.C. 154(b) by 0 days.

(21) Appl. No.: 09/257,641

(22) Filed: Feb. 25, 1999

Related U.S. Application Data

(63) Continuation-in-part of application No. 09/092,542, filed on Jun. 5, 1998, now Pat. No. 6,189,972.

(51) Int. Cl.[7] ..... A47L 3/025

(52) U.S. Cl. ..... 297/284.4; 297/284.7; 297/284.4

(58) Field of Search ..... 297/284.7, 284.8, 297/284.4

(56) References Cited

U.S. PATENT DOCUMENTS

| | | | | |
|---|---|---|---|---|
| D. 358,515 | | 5/1995 | Adat et al. . | |
| 1,001,312 | * | 8/1911 | Sebring | 297/284.7 |
| 1,264,265 | * | 4/1918 | Brusius | 297/284.8 X |
| 2,469,657 | * | 5/1949 | Linda et al. | 297/188.06 X |
| 2,756,809 | * | 7/1956 | Endresen | 297/284.8 X |
| 3,463,544 | | 8/1969 | Froelich . | |
| 3,880,463 | | 4/1975 | Shephard et al. . | |
| 3,948,558 | * | 4/1976 | Obermeier et al. | 297/284.4 |
| 4,156,544 | * | 5/1979 | Swenson et al. | 297/284.7 X |
| 4,295,681 | | 10/1981 | Gregory . | |
| 4,354,709 | | 10/1982 | Schuster . | |
| 4,452,485 | | 6/1984 | Schuster . | |
| 4,465,317 | | 8/1984 | Schwarz . | |
| 4,601,514 | * | 7/1986 | Meiller | 297/284.4 |
| 4,632,454 | * | 12/1986 | Naert | 297/284.7 X |
| 4,647,066 | * | 3/1987 | Walton | 297/284.8 X |
| 4,730,871 | | 3/1988 | Sheldon . | |
| 4,893,872 | * | 1/1990 | Sugai | 297/284.8 |
| 5,050,930 | | 9/1991 | Schuster et al. . | |
| 5,174,526 | | 12/1992 | Kanigowski . | |
| 5,217,278 | | 6/1993 | Harrison et al. . | |
| 5,335,965 | | 8/1994 | Sessini . | |

(List continued on next page.)

FOREIGN PATENT DOCUMENTS

| | | | | |
|---|---|---|---|---|
| 557421 | * | 5/1957 | (BE) | 297/284.8 |
| 1113192 | | 11/1981 | (CA) . | |
| 1125159 | | 6/1982 | (CA) . | |
| 1234040 | | 3/1988 | (CA) . | |
| 1235994 | | 5/1988 | (CA) . | |
| 2059537 | | 2/1991 | (CA) . | |
| 2075383 | | 9/1991 | (CA) . | |
| 1302858 | | 6/1992 | (CA) . | |
| 1309009 | | 10/1992 | (CA) . | |
| 2144860 | | 4/1994 | (CA) . | |
| 2165436 | | 1/1995 | (CA) . | |
| 2120456 | | 2/1995 | (CA) . | |
| 2183864 | | 8/1995 | (CA) . | |
| 2189347 | | 11/1995 | (CA) . | |
| 2197313 | | 2/1996 | (CA) . | |
| 2174419 | | 3/1996 | (CA) . | |
| 2181776 | | 1/1998 | (CA) . | |
| 3336349 | * | 4/1985 | (DE) | 297/284.4 |
| 0 419 714 A1 | | 9/1989 | (EP) | A47C/7/46 |
| 0 700 653 A3 | | 3/1996 | (EP) . | |
| 0849798 | * | 9/1960 | (GB) | 297/284.4 |
| 2035792 | * | 6/1980 | (GB) | 297/284.4 |
| WO 93/25404 | | 12/1993 | (WO) | B60N/2/44 |

*Primary Examiner*—Anthony D. Barfield
(74) *Attorney, Agent, or Firm*—Laff, Whitesel & Saret, Ltd.

(57) ABSTRACT

A chair back is provided with an adjustable lumbar support member. The vertical height of the lumbar support member and/or the amount of lumbar support which is provided by the chair back may be adjusted. The controls for adjusting the lumbar support member are positionable on the sides and the rear surface of the chair back.

37 Claims, 12 Drawing Sheets

U.S. PATENT DOCUMENTS

| | | | | |
|---|---|---|---|---|
| 5,344,211 | | 9/1994 | Adat et al. . | |
| 5,397,164 | | 3/1995 | Schuster et al. . | |
| 5,449,219 | | 9/1995 | Hay et al. . | |
| 5,452,868 | | 9/1995 | Kanigowski . | |
| 5,474,358 | | 12/1995 | Maeyaert . | |
| 5,498,063 | | 3/1996 | Schuster et al. . | |
| 5,553,917 | | 9/1996 | Adat et al. . | |
| 5,553,919 | | 9/1996 | Dennis . | |
| 5,567,010 | | 10/1996 | Sparks . | |
| 5,567,011 | | 10/1996 | Sessini . | |
| 5,624,158 | | 4/1997 | Adat et al. . | |
| 5,626,390 | | 5/1997 | Schuster et al. . | |
| 5,641,205 | | 6/1997 | Schmidt . | |
| 5,664,841 | | 9/1997 | Dal Monte . | |
| 5,823,620 | * | 10/1998 | Le Caz | 297/284.4 |
| 5,913,569 | * | 6/1999 | Klingler | 297/284.4 |
| 6,013,040 | * | 1/2000 | Mortgenstern et al. | 297/284.4 X |

* cited by examiner 74
20
70
25
24
27
23
76
23

FIG. 5. A-A
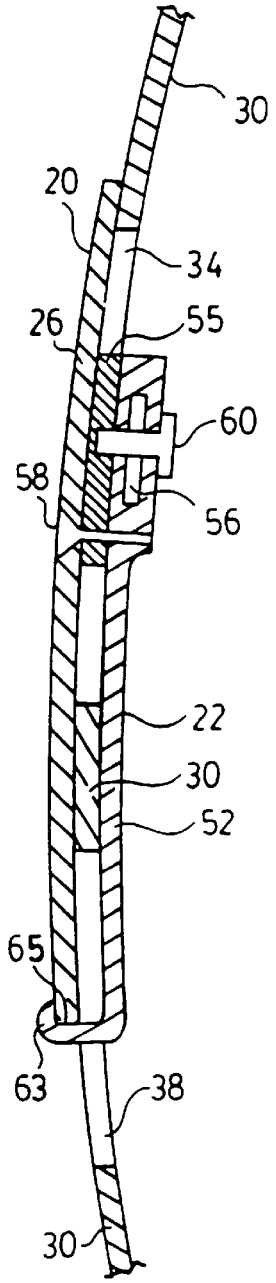
FIG. 6. B-B
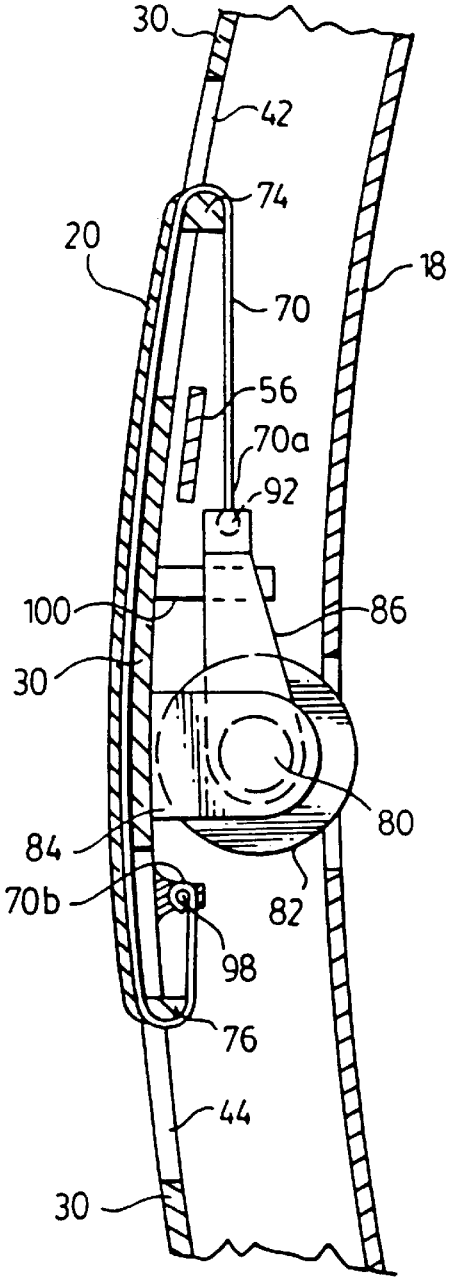

126

126
10
122
125
150
158
112
166
125
160
125
20
120
130
116
120
126
110
125
148
82
134
168
112
130
120
128
126
140
114
142
132
136

LUMBAR SUPPORT ADJUSTMENT MECHANISM

This application is a continuation-in-part of application Ser. No. 09/092,542 filed on Jun. 5, 1998 is now U.S. Pat. No. 6,189,972.

FIELD OF THE INVENTION

The present invention relates to an adjustable back or lumbar support for a seat. In particular the present invention relates to a back support having means for adjusting both the amount of lumbar support and the vertical position of the lumbar support.

BACKGROUND OF THE INVENTION

Lumbar supports exist in various forms to support the lumbar region of the human spine. Many of these prior art designs include a support which extends outwardly or curves outwardly to produce support against an appropriate position of the back. While prior art designs for adjusting the horizontal position of a lumbar support in this manner are known, these mechanisms typically include a large number of parts and are difficult, time-consuming, and costly to manufacture.

In addition, while a number of designs do provide for the horizontal adjustment of a back support, many of these do not include means for adjusting the vertical position of the support, thus reducing the available range of support positions and the potential for users of different shapes and sizes to use the seat. While prior art designs for adjusting both the horizontal and vertical positions of a lumbar support are known, these mechanisms are again complex and expensive to manufacture. More importantly it is generally desirable to minimize the thickness and size of the seat back, particularly with respect to any horizontal adjustment mechanism; something which complex and intricate lumbar support mechanisms do not generally permit.

For instance, U.S. Pat. No. 4,295,681 to Gregory shows a lumbar support device having two control means; one for adjusting the outward movement of the lumbar support and the other for adjusting the height of the lumbar support. Gregory uses a relatively large and complex mechanism consisting of a pair of link members and trunnions located on a threaded adjustment nut, one of which is on a shaft having a right hand thread, and the other is on a shaft having a left hand thread.

In Barley, U.S. Pat. No. 4,313,637, the lumbar support mechanism is positioned between spaced pairs of support arms. The respective arms of each pair are connected to define levers which adjust the amount of lumbar support which is provided.

Zacharkow, in U.S. Pat. No. 4,981,325, discloses a chair back having an upper back support member and a lower back support member. The lumbar support mechanism uses arms that extend from a threaded rod and are pivotally connected to the cushion which provides the lumbar support. The means for controlling the tilt of the lumbar support cushion is provided between the end of the arm and the cushion.

Sessini, U.S. Pat. Nos. 5,335,965 and 5,567,011, discloses a horizontally and vertically adjustable lumbar support device which utilizes a curved elastic plate and two vertically disposed threaded rods. The distal end of each rod is non-rotatably connected to one end of the curved elastic plate while the inner end of each rod is threadedly received in cylindrical scroll. The control is positioned an the side of the seat back and is connected to the lumbar support by multiple linkages. The support is adjusted vertically on a pair of vertical guides by means of control mechanism which includes a cord.

All of these support mechanisms require relatively large and complex mechanisms to enable adjustment of the amount of lumbar support which is provided by the device. Simplicity, reliability, and durability of design are also especially important since the lumbar adjustment mechanisms are generally located, for the most part, inside the upholstered seat back of the chair, and repairs are often difficult if not impossible to make.

Sheldon, U.S. Pat. 4,730,871, discloses a device which includes a vertical track and a guide made of spring steel which is mounted to be movable up and down in the track. The guide has a central portion spaced from the track to which the lumbar support member is attached. A screw member extends through the track to the lumbar support member. Rotation of the screw member allows the lumbar support member to be loosened to move vertically in the track and also causes the lumbar support member to be drawn rearwardly or pushed forwardly. While Sheldon discloses a simpler device, one problem with this mechanism is that a single control is used to adjust the vertical and horizontal adjustment of the lumbar support. Thus, the setting of the position and the amount of lumbar support are not independent. For example, when adjusting the height of the lumbar support, the amount of lumbar support may be affected.

SUMMARY OF THE INVENTION

In accordance with the instant invention, there is provided a chair back comprising a rear surface, a front surface spaced from the rear surface and a side extending between the front and rear surfaces; a lumbar support member positioned between the front and rear surfaces; a horizontal position adjustment member for adjusting the amount of support provided by the lumbar support member; a height adjustment member for adjusting the vertical height of the lumbar support member; a first controller drivingly connected to the horizontal position adjustment member; and, a second controller drivingly connected to the height adjustment member, one of the first and second controllers is positioned adjacent one of the sides of the chair back and the other of the first and second controllers is positioned on the rear surface of the chair back.

One advantage of the instant invention is that by providing independent controls for the height adjustment and the amount of support provided by the lumbar support member, the controls and their positioning may be simplified. For example, it is difficult to quickly and correctly position the height of the lumbar support member while not seated in a chair. By positioning the height adjustment control on the side of the back rest, the user may easily adjust the height of the lumbar support member to suit their physiology.

Further, by providing a control on each side of the chair back, the control mechanism may be easily actuated by both right handed and left handed individuals.

By positioning the control to adjust the amount of support provided by the lumbar support in the centre of the back rest, the control mechanism may be simplified, thus simplifying the manufacture of the device and, by reducing the number of linkages involved, increasing its reliability.

In one embodiment, the first controller is positioned on the rear surface of the chair back.

In another embodiment, the side has a longitudinally extending opening, the second controller extends through the opening to the lumbar support member and travels along the opening as the height of the lumbar support member is adjusted.

In another embodiment, the height adjustment member comprises a longitudinally extending track on which the lumbar support member is longitudinally moveable and friction elements which maintain the lumbar support member in position on the track.

Preferably, the chair back includes a frame and the track comprises at least one opening in the frame, the opening having a side wall defining the outer perimeter of the opening, and the friction elements releasably engages the side wall of the opening. Further, the height adjustment member has at least one runner which travels in the track, the side walls of the track being spaced apart at a plurality of discrete locations by a distance less than the thickness of the runner to frictionally engage the runner to hold the lumbar support member in position with respect to the chair back.

Alternately, the chair back may include a frame having a front face and a rear face and the track may comprise at least one opening in the frame, the height adjustment member comprising a frame member positioned on the rear face of the frame and at least one runner which extends through the frame to engage the lumbar support member positioned on the front face of the frame, the at least one runner having a length sufficiently small to cause a portion of the lumbar support member and the frame member to engage the frame.

In another embodiment, the horizontal position adjustment member includes a tensionable cable.

Preferably, the lumbar support member comprises a compressible member affixed to one end of the cable, the compressible member extending forwardly when the cable is tensioned. The compressible member may comprise a flexible panel having an upper end and a lower end and the first controller may comprise a rotatable knob whereby rotation of the knob tensions the cable and causes at least one of the upper and lower ends of the flexible panel to move towards the other such that the panel bows forwardly. Further, the chair back may further comprise a frame and the horizontal position adjustment member may further comprise an arm member pivotally mounted on the frame, a first arm of the arm member being connected to the cable and a second arm extending to contact the first controller, and the first controller may include a member mounted for transverse movement whereby transverse movement of the member in one direction causes the second arm to move transversely and the first arm to move vertically to compress and bow the flexible panel.

Alternately, the chair back may further comprise a frame, the compressible member may comprise a panel positioned in front of the frame and a deflecting member positioned between the frame and the panel, the deflecting member affixed to one end of the cable, at least a portion of the deflecting member moveable with the cable whereby tensioning of the cable causes adjusts the position of the deflecting member to move a portion of the panel outwardly. The deflecting member may be affixed to the rear surface of the panel and the first controller may comprise a rotatable knob.

In accordance with another embodiment of the instant invention, there is provided a height adjustment mechanism for a lumbar support for a seat back comprises a rigid support member for the seat back, the rigid support member having at least one longitudinally extending track, the lumbar support member mounted on the at least one track and longitudinally moveable thereon to adjust the position of the lumbar support member with respect to the chair back, and friction elements which maintain the lumbar support member in position on the track.

In one embodiment, friction elements are provided at discrete locations along the track. The friction elements may comprise first engagement members provided on the track and at least one second engagement member provided on the lumbar support member which releasably engages at least one of the first engagement members as the lumbar support member moves longitudinally along the track. The track may comprise an opening in the rigid support member for the seat back and the first engagement members may comprise narrowed portions of the opening.

Alternately, the rigid support member may have a front face and a rear face and the track may comprise at least one opening in the rigid support member, the height adjustment mechanism may further comprise a frame member positioned on the rear face of the rigid support member and at least one runner which extends through the rigid support member to engage the lumbar support member positioned on the front face of the rigid support member, the at least one runner having a length sufficiently small to cause a portion of the lumbar support member and the rigid support member to engage the frame whereby the portion of the lumbar support member and the rigid support member comprise the friction elements.

In accordance with another embodiment of the instant invention, there is provided a lumbar adjustment mechanism for mounting in a seat back having a frame and a rear surface and adjusting the amount of support provided by a lumbar support comprising a lumbar support member; a controller positionable on the rear surface of the seat back; and, a cable having a first end connected to the lumbar support member and a second end to the controller whereby adjustment of the controller tensions the cable and adjusts the amount of lumbar support which is provided.

BRIEF DESCRIPTION OF THE DRAWINGS

These and other advantages of the instant invention will be more fully and completely understood in association with the following description of the preferred embodiment of the invention in which:

FIG. 5 is a sectional view along the lines A—A in FIG. 3;

FIG. 6 is a sectional view along the lines B—B in FIG. 3;

DETAILED DESCRIPTION OF THE INVENTION

Figure 1:
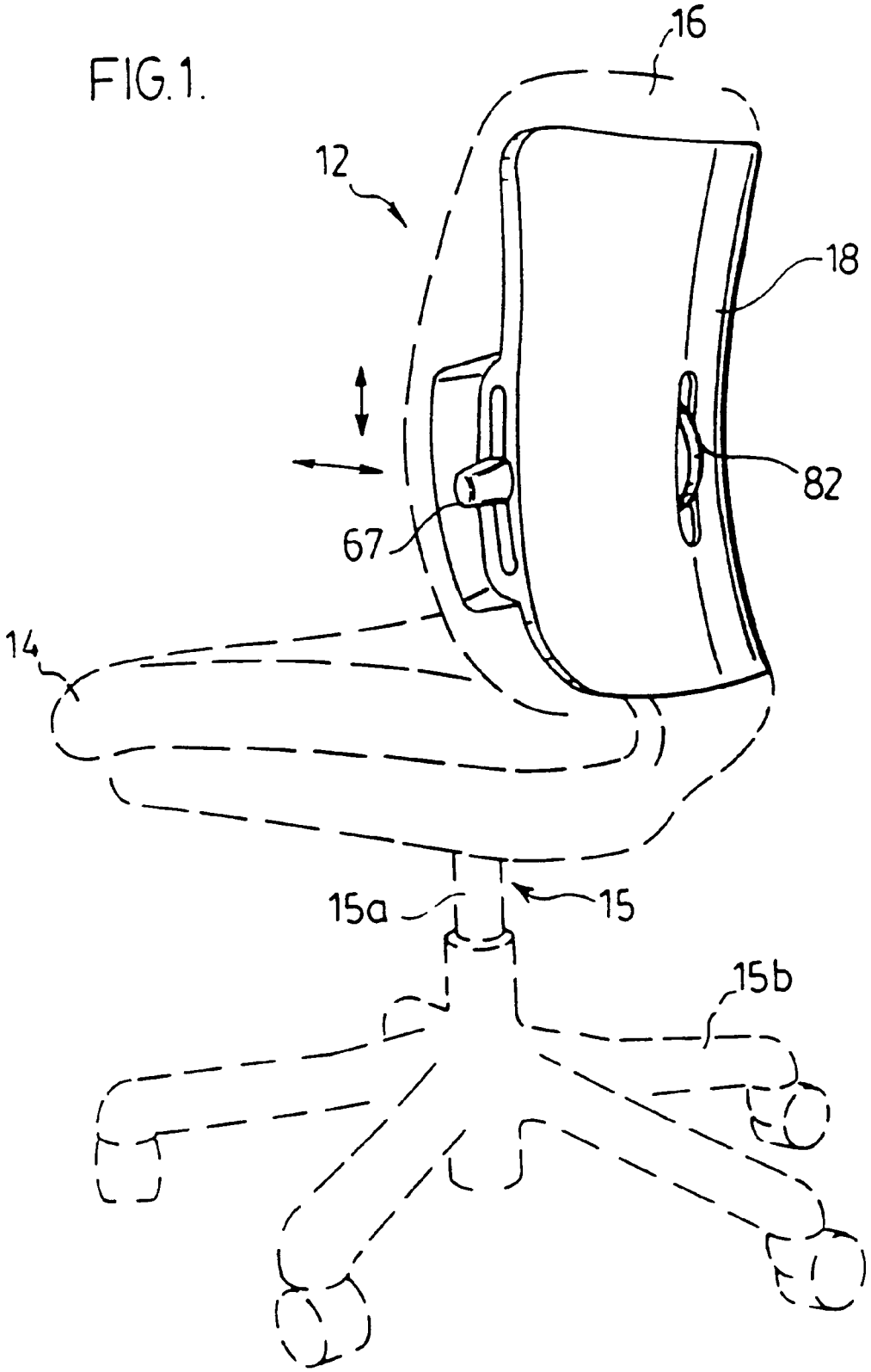
FIG. 1 shows a seat or chair having a first preferred embodiment of the lumbar support adjustment mechanism of the present invention integrated therein.

FIG. 1 shows a chair 12 with the adjustable lumbar support mechanism of the present invention integrated therein. The chair 12 comprises a seat portion 14 and a seat back portion 16, the seat back portion having a back cover 18. Seat back portion 16 may be of any shape or configuration known in the art.

Chair 12 may be a seating unit of any general type, shape or configuration. As shown in the preferred embodiment, chair 12 is an office chair or a task chair where a person may be seated for an extended period of time while working.

Seat portion 14 may be mounted on a support member 15 for supporting seat portion 14 at an elevated height. Preferably, the support member 15 comprises a longitudinally extending cylinder 15*a* (which, more preferably, is a pneumatic cylinder) having a wheeled base 15*b* as shown in FIG. 1.

The lumbar support mechanism forms part of the seat back portion 16 and, as explained in detail below, may be independently adjusted in one or both of the horizontal direction (via a controller, eg. knob 82) and the vertical direction (via a controller, eg. handle 67) as indicated by the double-headed arrows in FIG. 1. The term vertical is used herein as a general direction reference and not an absolute term and is intended to be understood with reference to the plane passing upwardly through seat back portion 16. The term horizontal is used herein as a general direction reference and not an absolute term and is intended to be understood with reference to the plane transverse to the plane passing upwardly through seat back portion 16.

In one preferred embodiment, the lumbar support includes a mechanism to increase or decrease the amount of lumbar support which is provided. To this end, a flexible support 20 which extends outwardly under compression may be provided. Alternately, a support plate (which may be flexible such as flexible support plate 20) may be deflected outwardly by a pivoting member. In either case, the adjustment for controlling the amount of lumbar support which is provided may be actuated by a rotatable member which tensions and relaxes a cable (which may be a sheathed cable such as a Bowden cable or unsheathed).

In another preferred embodiment, the lumbar support alternately includes, or may in addition include, a height adjustment mechanism. To this end, seat back 16 may be provided with a frame 30 having a track for vertical travel of the lumbar support device with respect to seat back 16. The seat back preferably includes a locking member to fix the lumbar adjustment mechanism at a desired vertical position in the seat back. The lumbar adjustment member may be locked in position by friction, in which case the locking members may be portions of frame 30 and the lumbar adjustment mechanism which interact to create the friction. Alternately, the height adjustment may be controlled by gearing, cable, springs or a combination thereof and the locking may be caused by the interaction of the elements of the height adjutment mechanism. For example, the locking members may be the gears themselves and their interaction may create the locking effect, or the lumbar support member may be mounted on a track and the height adjustment means may comprise rack and pinion members which are actuated by a rotatably mounted control knob. Such height adjustment members may be operated by a control knob which is rotatable mounted in the seat back and, when rotated, causes the height of the lumbar adjustment mechanism to be adjusted thus allowing the user to position the lumbar adjustment mechanism to best suit their needs.

Figure 2:
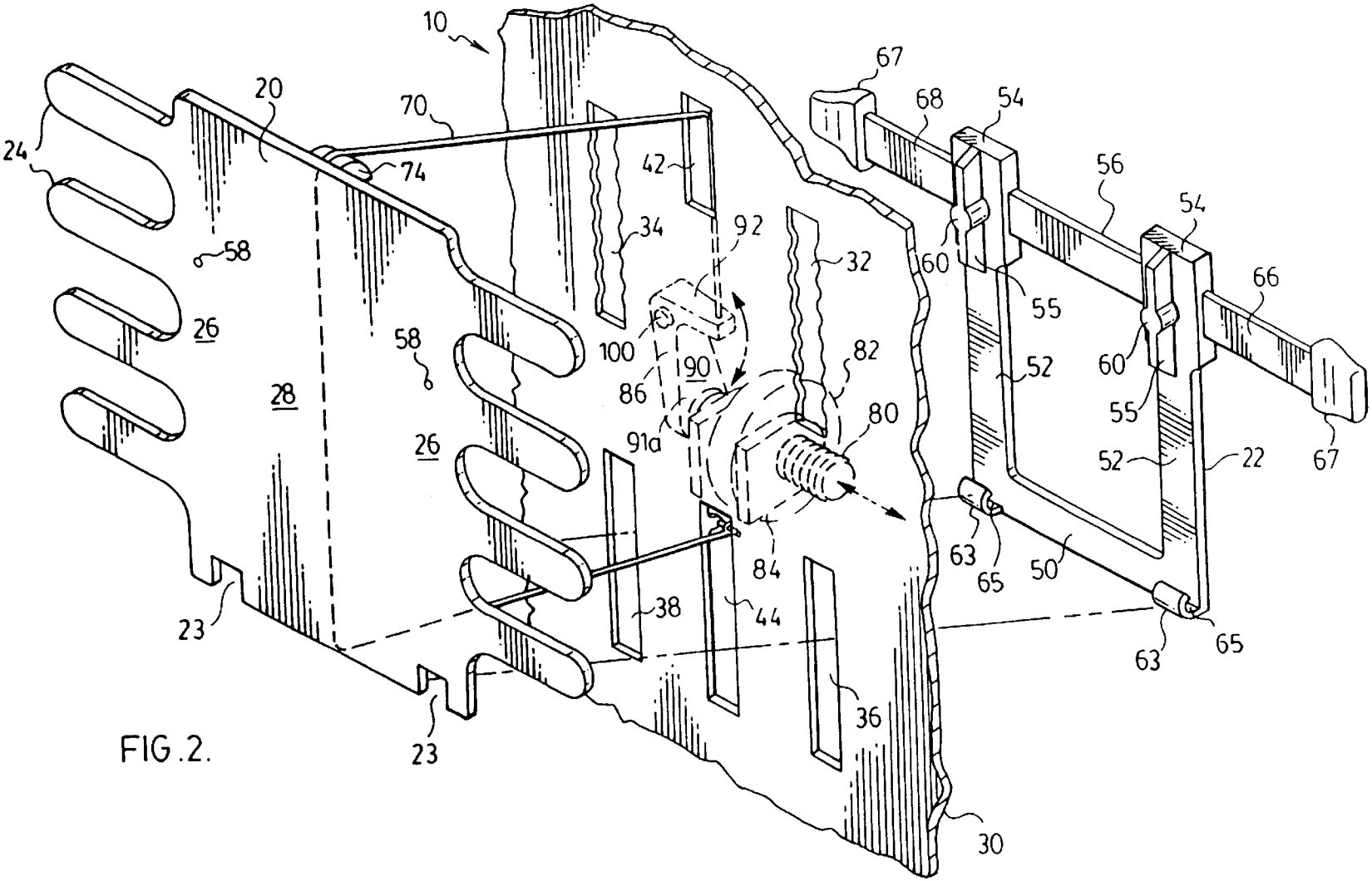
FIG. 2 shows an exploded view of the lumbar support adjustment mechanism of FIG. 1.
Figure 3:
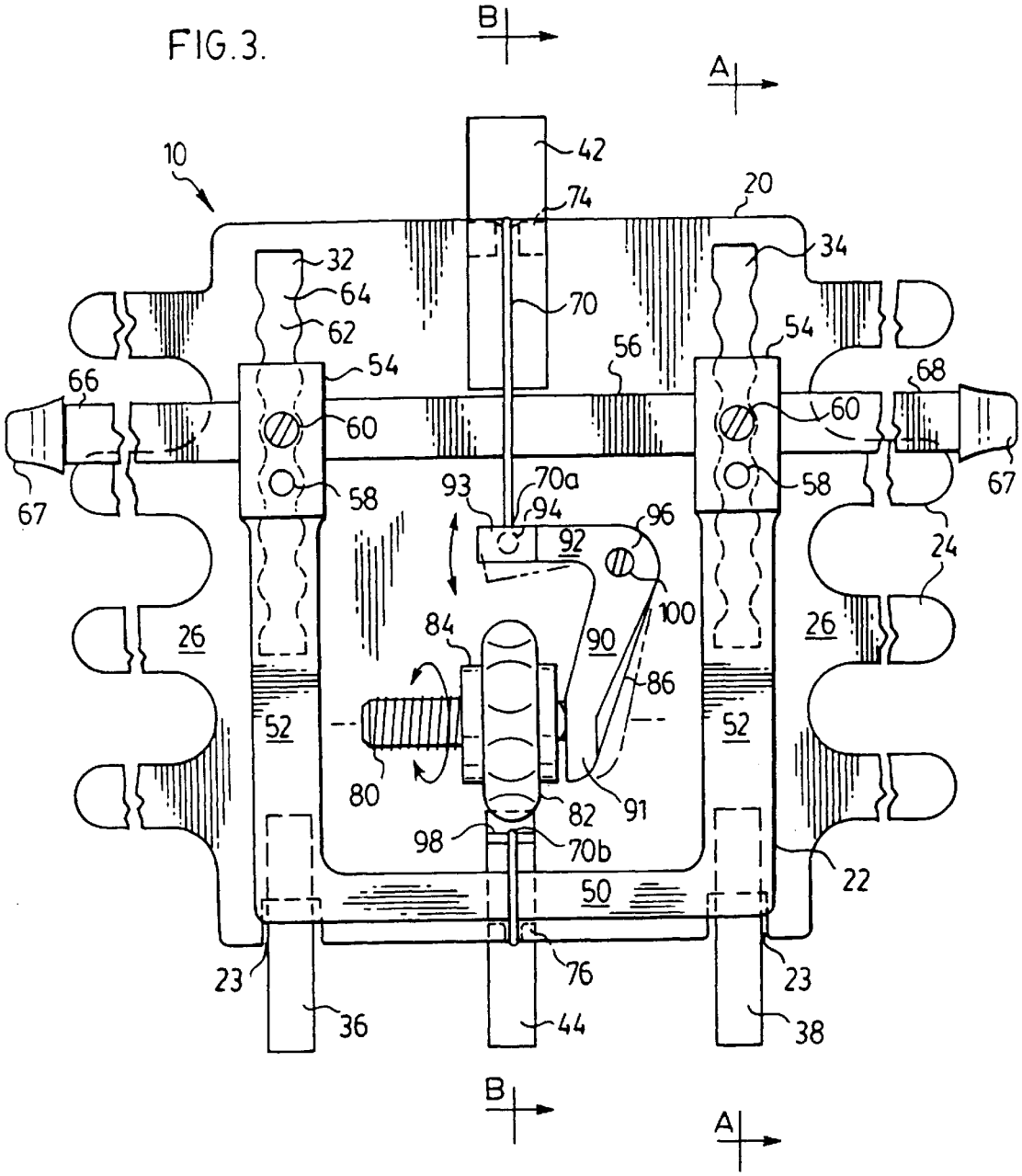
FIG. 3 is a back view of the lumbar support adjustment mechanism with the shroud of the back rest of FIG. 1 removed.

FIG. 2 shows a detailed exploded view of an adjustable lumbar support mechanism 10 of the invention which includes both adjustment means while FIG. 3 shows a detailed view of the rear of mechanism 10. The mechanism 10 comprises a flexible support member 20 mounted on a rigid support frame 22. If the lumbar support includes a height adjustment mechanism, then, as explained more fully below, the flexible support 20 is attached to the support frame 22 with the rigid seat back frame 30 (not shown in FIG. 3) of the seat back disposed therebetween. If the lumbar support does not include a height adjustment mechanism, then a portion of the flexible support 20 may be affixed to frame 30.

The exact shape or form of the seat back frame 30 is not dictated by the invention, and may be of any typically rectangular shape or other shape suitable to accommodate the seat back of a chair. Thus, the lumbar support of this invention may be adapted for use with any conventional chair back.

Figure 4:
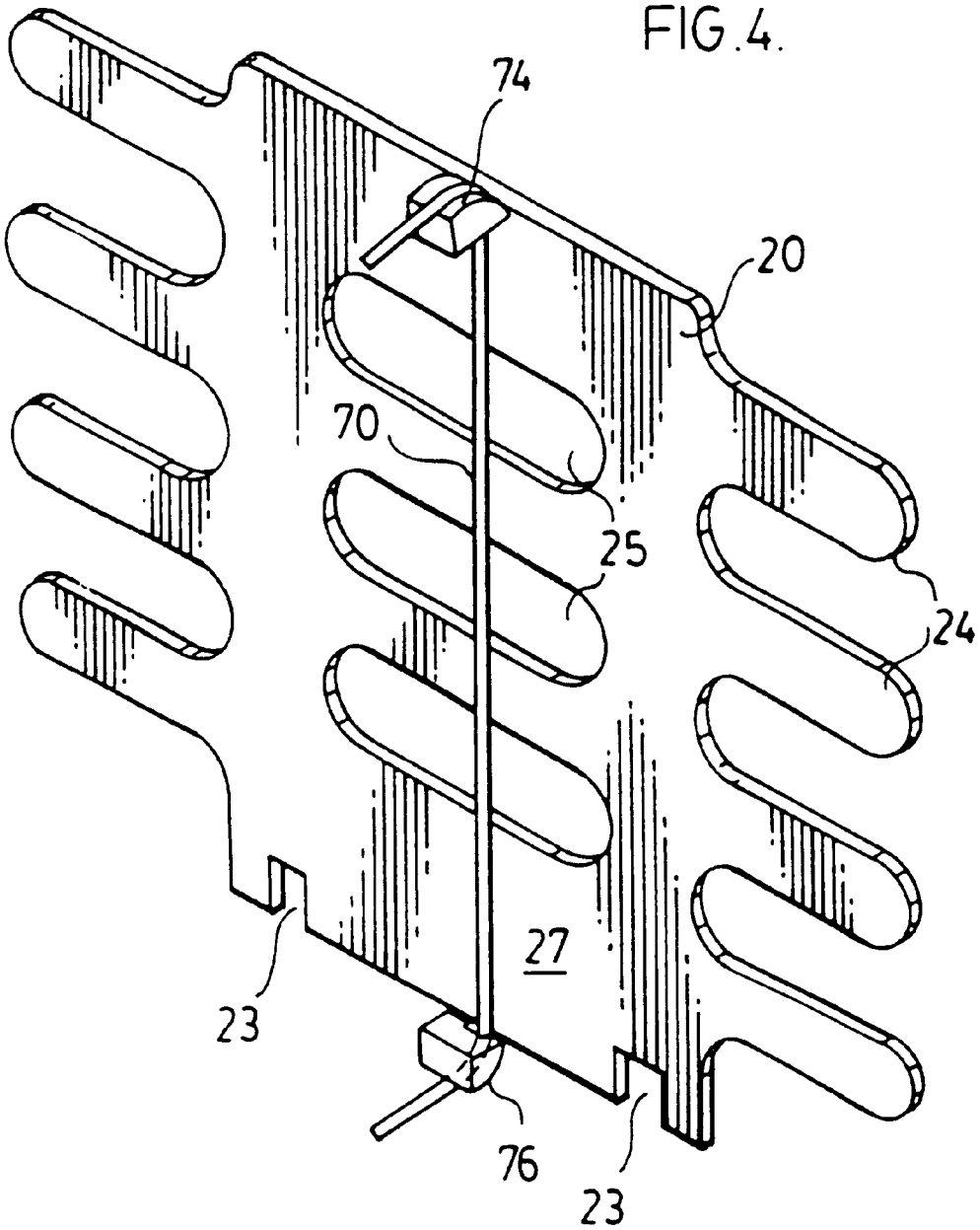
FIG. 4 shows an alternate embodiment of the flexible support member of FIG. 2.

The frames 22 and 30 are preferably made of metal or some other durable, rigid material. For example, frame 22 may be made from plastic and frame 30 may be made from a composite wood material. The flexible support 20 is of a resilient material which will expand outwardly when compressed and, when the compressive force is removed, will at least substantially resume its original shape. Preferably, flexible support 20 is a planar member which is composed of a suitably resilient material such as sheet metal, a plastic or the like so that it may be repeatedly bent without any significant lose of flexibility and also without cracking or otherwise suffering fatigue damage. Preferably, support 20 also has a number of support fingers 24 which extend transversely from the sides 26 of the support 20. The support fingers 24 may be shaped to better accommodate the shape of a human back, as is known in the art. As shown in FIG. 4, the flexible support 20 may also comprise one or more holes or gaps 25 centred about the vertical median of the support so as to improve the support's flexibility in the longitudinal direction.

With reference to FIG. 2, within the seat back frame 30 are a plurality of aligned channels and, preferably, a plurality of pairs of upper and lower vertically extending channels. These channels are openings in seat back frame 30 that are sized and positioned to permit flexible support 20 and rigid frame 22 to move together upwardly or downwardly with respect to seat back frame 30.

Pursuant to the height adjustment mechanism of this preferred embodiment of the invention, frictional engagement is used to hold the lumbar support at various heights. Accordingly, the track may have first engagement members and the support frame 22 and/or the flexible member 20 may have a second engagement member which releasably engages the first engagement members as the lumbar support member moves longitudinally along the track. The frictional engagement may be provided by an abutment surface provided on the inside of one or more of the channels and/or by an abutment surface provided on the front or the rear face of seat back frame 30. The frictional engagement may be continuous, to permit the infinite adjustment of the lumbar support within the channels, or intermittent, to define a series of preset positions.

For example, in the preferred embodiment shown in the drawings, there is provided a pair of upper vertical aligned channels 32 and 34 and a pair of lower vertical aligned channels 36 and 38. The transverse width of the upper vertical channels 32 and 34 varies between a certain minimum width 64 and a certain maximum width 62 (see FIG. 3) so as to define alternating portions which vary in thickness. The lower channels 36 and 38 may be generally rectangular and may have a fixed transverse width. The seat back frame 30 also contains two other gaps or recesses (or channels) 42 and 44. Gap 42 may be located in the upper median portion of the frame 30, whereas gap 44 may be located in the lower median portion of the frame 30 and vertically aligned with the lower vertical channels 36 and 38.

The support frame 22 may be of any particular shape as long as it provides a rigid support on which flexible support 20 may be mounted. Preferably, as shown in FIGS. 2 and 3, support frame 22 has a U-shape, with a lower base portion 50 and two side portions 52.

Flexible support 20 is mounted on frame 22 to be moveable therewith while still being compressible to bow outwardly. It will be appreciated that at least the top or the bottom of flexible support 20 must be vertically compressible with respect to frame 22 for the amount of lumbar support provided by flexible support 20 to be adjustable. It will also be appreciated that both the top and the bottom of flexible support 20 may be compressible with respect to frame 22.

As shown in FIG. 2, support frame 22 may include forward projecting appendages 63 having hooks 65 for receiving and supporting the slotted out portions 23 at the sides of the bottom end of the flexible support member 20. As hooks 65 are not physically attached to flexible support 20, the lower portion of flexible support 20 may move upwardly to an extent with respect to hooks 65. It will be appreciated that, in an alternate embodiment, the lower portion of flexible support 20 may be affixed to frame 22 in a variety of different manners and may be fixedly attached thereto, eg. by means of screws, glue and the like.

Cable 70 engages the upper portion of flexible support 20 and, due to the tension in cable 70, maintains the upper portion of flexible support 20 in place with respect to frame 30 while leaving flexible support 20 free to bow outwardly when the tension of cable 70 is increased. It will also be appreciated that the upper portion of flexible support 20 may be affixed to frame 22 and that the lower portion may be maintained in place with respect to frame 30 while leaving flexible support 20 free to bow outwardly.

The sides 26 of the flexible support member 20 may be fixed to the top ends 54 of side portions 52 of the support frame 22 by means, for example, of anchoring devices 58 (see FIGS. 2, 3 and 6). The anchoring devices may pass, for example, through the narrow vertical portion 55 which abut the top ends 54 (see FIG. 2). Alternately, anchoring devices 58 may be positioned at any location whereby they pass through a channel in frame 30 so that they will not hinder the vertical movement of flexible member 20. Anchoring devices 58 may comprise screws, but other means for fastening the support 20 to the support frame 22 may also be used. It will be appreciated that by affixing sides 26 to support frame 22, only the central portion of flexible support 20 will bow outwardly to provide lumbar support. If desired, sides 26 may remain unaffixed to support frame 22 thus allowing the sides 26 to bow outwardly with the central portion of flexible support 20 so as to provide a transversely extending lumbar support across the entire width of flexible member 20. It will also be appreciated that a narrow flexible support 20 may be provided to provide only a narrow flexing lumbar support surface thus avoiding the need for anchoring devices 58.

Height adjustment bar 56 comprises a transversely extending member having opposed sides 66 and 68. The sides 66 and 68 extend outwardly from the sides of the seat back portion 16 as illustrated in FIG. 1 and have a handle 67 or other type of manipulation means attached to their ends to facilitate the application of force by a user. Height adjustment bar 56 is affixed to frame 22. For example, the top ends 54 of the side portions 52 of frame 22 may be thicker than the remainder of the side portions and also include a gap (not shown) through which height adjustment bar 56 is fitted, as illustrated in FIG. 2. The top ends 54 may also be somewhat wider in the transverse direction than the remainder of side portions 52, as best seen in FIG. 3.

In the preferred embodiment, the frictional engagement is provided by runners positioned in the channels in frame 30. Engagement members 60, which may be cylindrical plugs or other suitable devices, are inserted, for example, through the top ends 54 of the support frame 22 and through height adjustment bar 56 into the vertical channels 32 and 34 respectively to act as runners in the channels. Referring to FIG. 3, engagement members 60 are of a size and shape (preferably cylindrical) such that they move freely within portions 62 of the vertical channels 32 and 34 having a relatively larger width and they are statically immoveable within portions 64 of the vertical channels 32 and 34 having a relatively smaller width to define a series of preset positions. The term statically immoveable is intended to indicate that the engagement members 60 will not move until a force at or above a certain threshold has been applied to them. This prevents the lumbar support from being accidentally moved once the user places the lumbar support in a desired position.

It will be appreciated that height adjustment bar 56 need not be horizontal but may be of any particular configuration that can transmit a vertical (i.e. upward or downward) force from a position adjacent the side of seat back 16 to frame 22.

Thus the height of the flexible support member 20, which is mounted on support frame 22, may be adjusted by applying a sufficient amount of force either upwardly or downwardly at one handle 67 on one of the sides 66 and 68 of the horizonal height adjustment bar 56. The engagement members 60 may thereby be moved from one portion of the channels 32 and 34 in which they are statically immoveable to another portion in which they are also statically immoveable. Referring to FIG. 2, as the engagement members 60 travel up and down the vertical channels 32 and 34, the forward projecting appendages 63 at the sides of the base portion 50 of the support frame 22 simultaneously and correspondingly travel up and down the vertical channels 36 and 38 in the seat back frame 30.

Channels 32, 34, 36 and 38 define a vertical track along which flexible support 20 may travel. Each channel is positioned to provide a track adjacent one of the corners of flexible support 20 thereby preventing, or minimizing, transverse motion of flexible member 20 as it travels upwardly or downwardly. It should be noted that although a preferred embodiment of the present invention uses an upper pair of channels (32 and 34) and a lower pair of channels (36 and 38), a differing or the same number of channels positioned at differing or the same locations may be used.

It will be appreciated that narrow portions 55 may be provided to act as stops to engage the upper and lower surfaces of the channels. In another embodiment, engagement members 60 may act as the stops.

An advantage of the instant invention is that the height adjustment of the lumbar support may be easily actuated while the user is seated in the chair. By mounting frame 22 so that it rides on a track (eg. the channels), the user need only grasp one handle 67 to apply the requisite force to height adjustment bar 56 to adjust the height of the lumbar support. It will be appreciated that height adjustment bar 56 may only extend transversely outwardly of one side of seat back 16. However, it is preferred that adjustment bar extends transversely outwardly of both sides of seat back 16 so that the height of the lumbar support may be easily adjusted by both a right handed and a left handed person.

Figure 9:
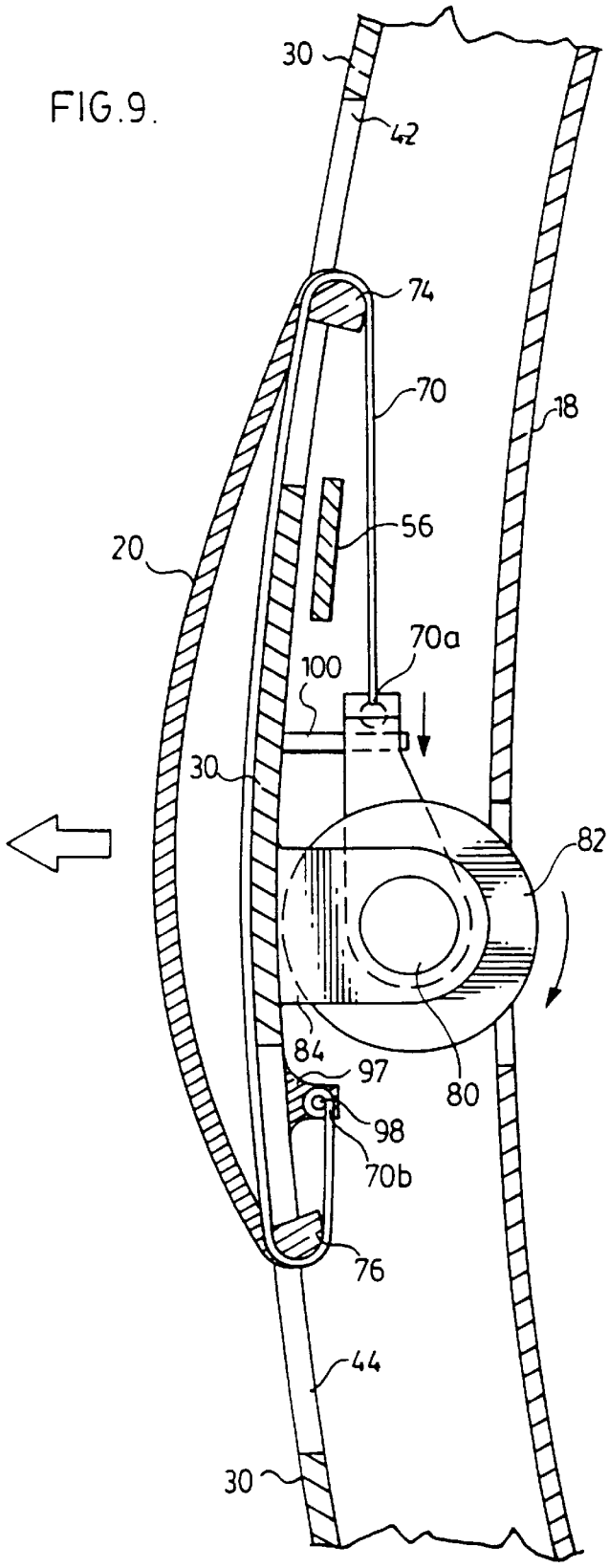
FIG. 9 illustrates the forward adjustment of the lumbar support member of the embodiment of FIG. 2.

The amount of lumbar support provided by flexible support 20 is adjusted by applying a compressive force to the upper and lower portions of flexible support 20. In the preferred embodiment, the compressive force is provided by a cable or other tension element 70 having a first end 70*a* and a second end 70*b* (FIG. 3). Cable 70 engages the upper and lower ends of the flexible support 20 and extends either along the rear surface 27 of flexible support 20 (eg. when the flexible support is in the relaxed, flat state as shown in FIG. 6) or rearwardly of the flexible support (eg. when flexible support is under tension as is shown in FIG. 9) whereby the flexible support bows forwarding in the direction of the arrow shown in FIG. 9 when compressed by cable 70.

As best illustrated in the cross-sectional view of FIG. 6, the median portion of the top edge of the flexible support 20 has a bearing member 74 which has an opening so that cable 70 may pass freely therethrough. Similarly, the median portion of the bottom edge of the flexible support 20 has a bearing member 76 which has an opening so that cable 70 may pass freely therethrough.

The cable 70 and bearing members 74 and 76 respectively, pass through the holes or gaps 42 and 44 in the seat back frame 30 which are vertically elongated as shown in FIG. 2 to accommodate variations in the height of the flexible support member 20. By increasing the tension of the cable or tension element 70, flexible support 20 is compressed and the vertically extending median portion of the flexible support member is arched or bowed forwardly (i.e. convexly) to provide lumbar support at varying horizontal positions and independently of height adjustment. As will be appreciated, cable 70 is preferably affixed to frame 30 so that the ends of cable 70 do not travel when flexible support 20 is adjusted vertically. Since cable 70 is free floating on bearing members 74 and 76, the forward bowing of flexible support 20 is not affected by the vertical movement of flexible support 20. It will be appreciated that cable 70 may be affixed to frame 22.

The amount of lumbar support may be varied by adjusting the length of cable 70. As the vertical travel of cable 70 is shortened, a compressive force is applied to the upper and lower portions of flexible support 20 thus causing flexible support to bow outwardly. Cable 70 may be shortened by winding cable 70 onto a spindle or the like. However, in order to reduce the force which must be applied to shorten cable 70, in the preferred embodiment, the vertical travel is shortened by transversely moving one end of cable 70.

Figure 7:
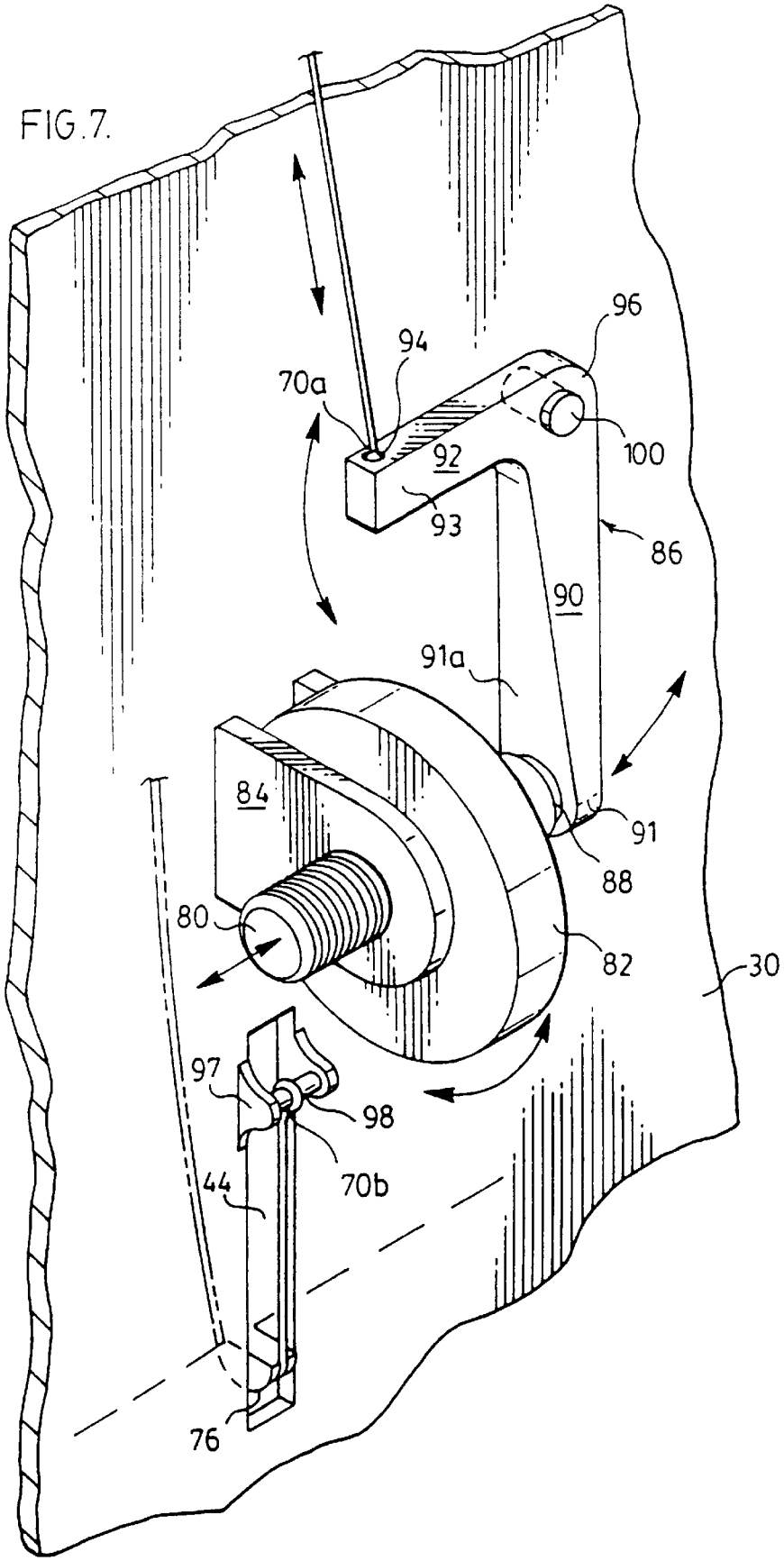
FIG. 7 shows a detailed view of the tension adjustment mechanism shown in FIG. 2.

FIG. 7 best illustrates a preferred embodiment of a means for adjusting the tension of the cable 70 to compress flexible support 20. A pair of attachment members 84 having openings (not shown) extend rearwardly from frame 30. A horizontal threaded shaft 80 having an abutment face 88 extends through the openings in attachment members 84. The openings are sufficiently large that threaded shaft 80 is rotatably mounted on attachment members 84. A rotatable hand-actuated knob 82 is threadedly mounted to the shaft 80 between attachment members 84. As hand actuated knob 82 is fixed in position between the pair of attachment members 84, rotation of knob 82 causes threaded shaft 80 to move transversely. As knob 82 rotates in one direction, causing threaded shaft 80 to rotate about its longitudinal axis, threaded shaft 80 moves transversely to the left when rotated in one direction and transversely to the right when rotated in the other direction.

Lever 86 is pivotally mounted to seat back frame 30 by any means known in the art. As shown in FIG. 7, lever 86 comprises first arm 90, second arm 92 and a base or fulcrum portion 96. Fulcrum 96 is pivotally attached to the seat back frame 30 by pivot mount 100. Arms 90 and 92 of the lever 86 are joined to fulcrum portion 96 of the lever, about which the lever (and the arms) pivot and rotate. Arm 90 has an end 91 distal to fulcrum 96 and arm 92 has an end 93 distal to fulcrum 96.

Abutment face 88 of the shaft 80 abuts face 91a of distal end 91 of first arm 90. Second arm 92 includes at or near end 93 means 94 for receiving and retaining therein end 70*a* of the cable 70. End 70*a* may be secured therein by any means known in the art such as by using a set screw or by providing an opening in end 93 through which cable 70 extends and providing end 70*a* with an enlarged stop (not shown).

End 70*b* of the cable 70 is fixedly attached to seat back frame 30. Therefore, as the position of end 70*a* of cable 70 is adjusted, the effective (or vertical) length of cable 70 is adjusted. End 70*b* may be affixed to seat back frame 30 by any means known in the art. For example, bracket 97 may be mounted to the rear face of seat back frame 30 with a rod 98 extending therebetween. End 70*b* may be provided with a loop through which rod 98 extends.

As shown in FIGS. 1 and 6, the back cover 18 of the seat back portion 16 contains a gap or hole through which the hand-actuated knob 82 protrudes for ease of manipulation by a user. In operation, as the knob 82 is rotated, the shaft 80 moves horizontally in a transverse direction. As shown for example in FIG. 3, as the shaft moves to the right, this forces the arms 90 and 92 of the lever 86 to rotate in a counterclockwise direction. Since cable 70 is effectively inelastic, as arm 90 moves to the right, the vertical distance travelled by cable 70 from end 70*b* to end 70*a* decreases so as to draw members 74 and 76 together. Thus cable 70 applies a compressive force to flexible support 20. Conversely, as the shaft 80 moves to the left, the arms 90 and 92 rotate about the fulcrum 96 in a clockwise direction and thereby allow the vertical distance travelled by cable 70 to increase. In this manner, the convex curvature of the vertical median of the flexible support member 20 can be adjusted to accommodate the lumbar support requirements of a particular seat user. The greater the rightward displacement of arm 90, the more bowed or curved is the vertical median of the flexible support member 20.

Figure 8:
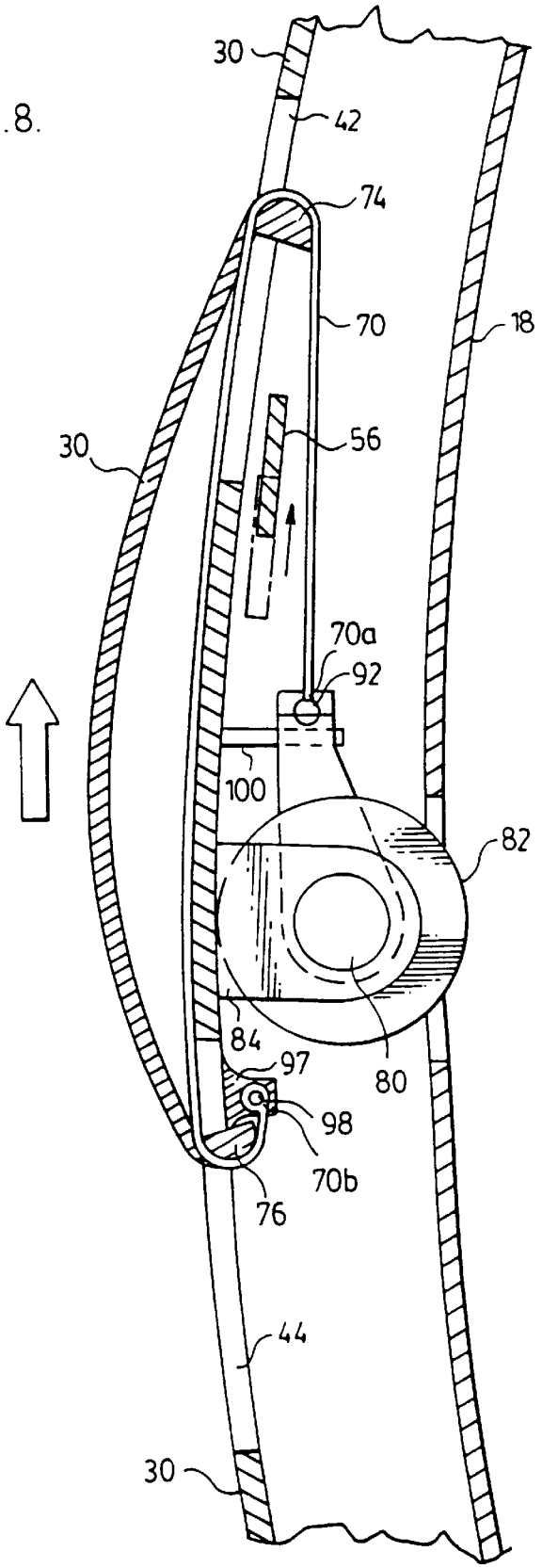
FIG. 8 illustrates the vertical adjustment feature of the embodiment of FIG. 2.

The present invention thereby independently provides both vertical adjustment of the support member 20 as illustrated in FIG. 8 and bowing adjustment of the vertical median of the support member as illustrated in FIG. 9. FIGS. 3 and 6 respectively illustrate the position of the tension adjustment mechanism and the bowing of the flexible support member 20 when the cable is under low tension. FIG. 9, on the other hand, illustrates the bowing of the vertical median of the flexible support member under a greater amount of tension.

Because the tension adjustment mechanism for cable 70 is fixed with respect to the seat back frame 30, the tension adjustment mechanism does not change position when the height of the flexible support member 20 is adjusted. This is illustrated in FIG. 8. Thus, as the height of flexible support 20 is adjusted, cable 70 slides around bearing members 74 and 76. As a result, it is unnecessary to create an elongated vertical gap in the back cover 18 of the seat back portion of the seat to accommodate for the protrusion of the hand-actuated knob 82.

Due to the independent nature of the two adjustment mechanisms, it will be appreciated that if the lumbar support in seat back 16 is not height adjustable, frame 30 need not be sandwiched between flexible support 20 and support frame 22. In fact, in such an embodiment, frame 30 may function as support frame 22. It will also be appreciated that, in another embodiment, a non-adjustable lumbar support member, or an alternate means of adjusting the amount of lumbar support which is provided by the lumbar support member, may be used in conjunction with the height adjustment member disclosed herein.

Figure 10:
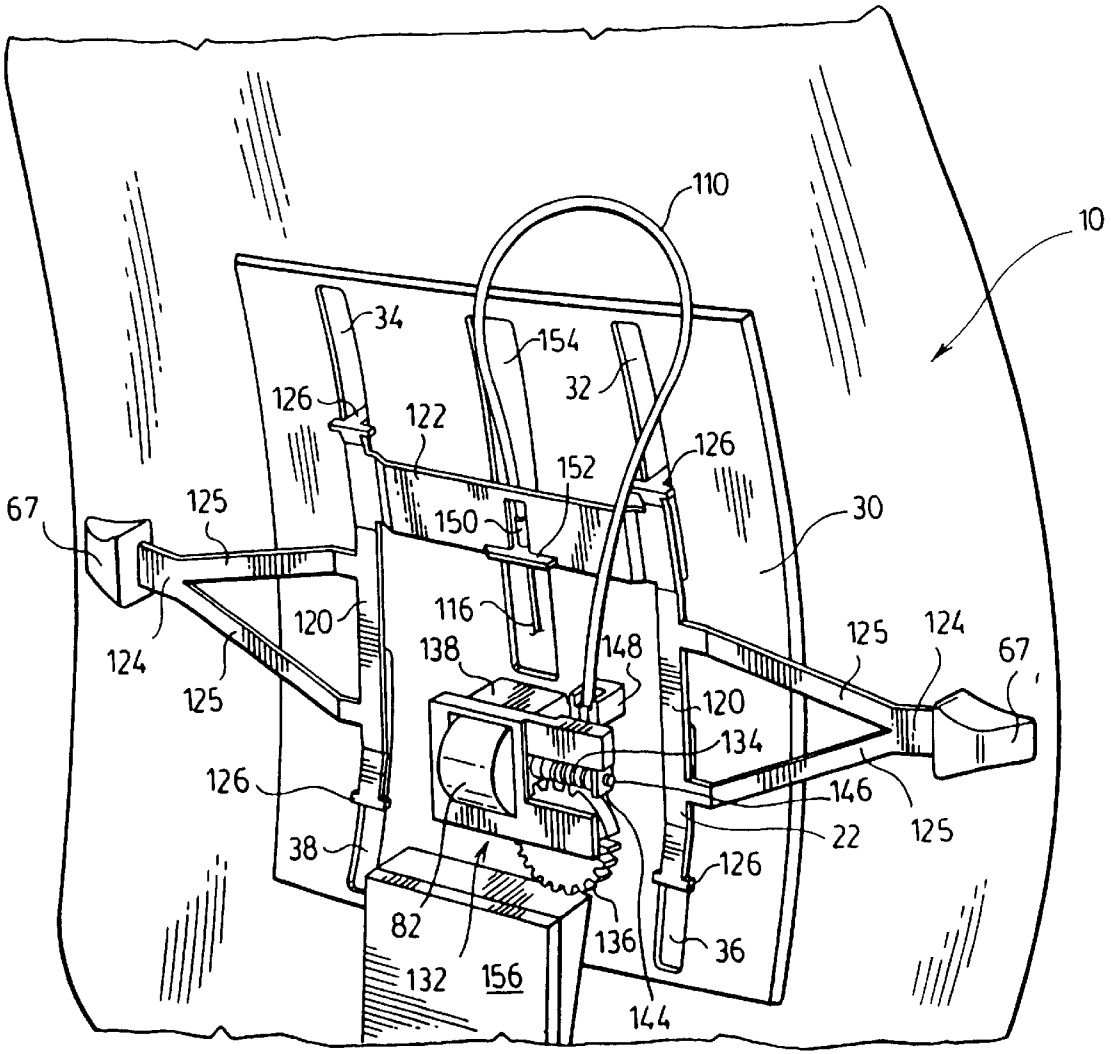
FIG. 10 is a perspective view from the rear of a second preferred embodiment of the lumbar support adjustment mechanism of the present invention.
Figure 11:
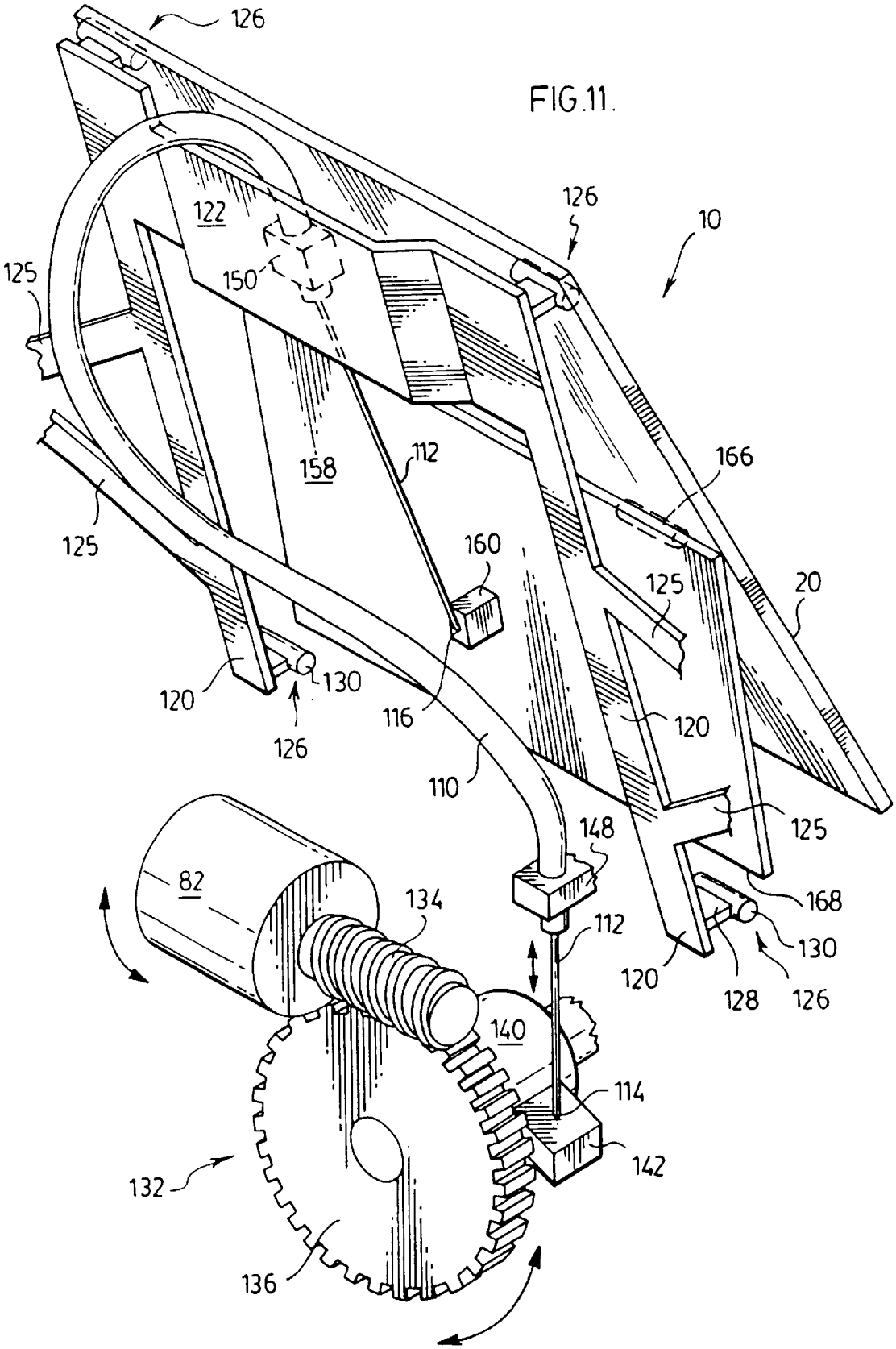
FIG. 11 is partially cut away view of a portion of the lumbar support adjustment mechanism of FIG. 10.
Figure 12:
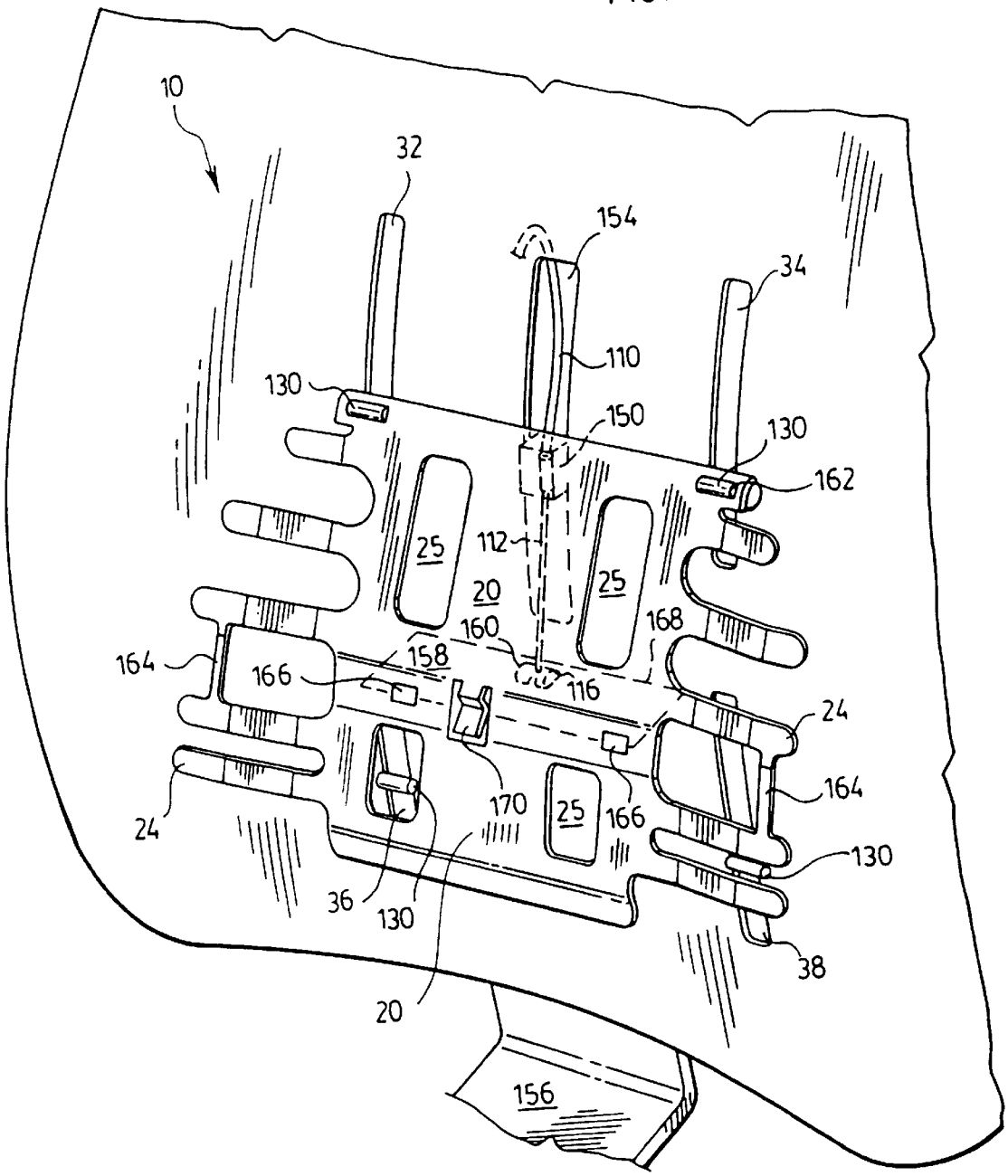
FIG. 12 is a perspective view from the front of the lumbar support adjustment mechanism of FIG. 10 mounted within the frame of a chair; and, FIG. 13 is an isometric rear view of the flexible support and attached hinge plate of the lumbar adjustment mechanism of FIG. 10.

A further preferred embodiment of the lumbar support adjustment mechanism is shown generally as 10 in FIGS. 10, 11 and 12, and comprises a flexible support 20, a support frame 22, a frame 30, an adjustment mechanism 132 and a hinged plate 158. Referring first to FIG. 10, frame 30 is fixed to the chair such as by being affixed to frame support 156. Frame 30 provides a base upon which support frame 22 (and accordingly the lumbar adjustment mechanism) may slide generally vertically. Support frame 22 may comprise two vertical members 120, a horizontal member 122, and vertical adjustment members 124. Vertical adjustment members 124 provide a means to move the rigid support frame 22 vertically so that the user may adjust the location of the flexible support 20 to best fit the lumbar or lordosis region of their back. Vertical members 120 are maintained in a position parallel to each other by horizontal support member 122.

Flexible support member 20 is connected to support frame 22 by any means known in the art so as to move vertically therewith. For example, as shown in FIGS. 11 and 12, a tongue 126 is provided proximate to the ends of each vertical member 120. Tongue 126 comprises a flange 128 and a retainer 130 which extend through frame 30 so as to engage support member 20. The retainers 130 of tongues 126 at the top end of each vertical member 120 may be pivotally received in retention receptacles 162 at the top of flexible support 20 (FIGS. 12 and 13), thus attaching the flexible support member 20 to support frame 22. Tongues 126 serve to guide the vertical movement of support frame 22 within channels 32, 34, 36 and 38 of frame 30. It will be appreciated that instead of pivotally mounting support member 20, support member 20 may be rigidly attached to frame 22 provided that support member 20 is sufficiently flexible to bend when deflected outwardly by hinged plate 158.

The lumbar adjustment mechanism also includes a locking member to retain the lumbar adjustment mechanism in position once the lumbar adjustment mechanism has been set at a particular position with respect to frame 30. In this embodiment, the lumbar support mechanism is locked in position by friction, such as that between frame 30 and frame 22 or that between frame 30, frame 22 and retainers 130. For example, the length of flange 128 may be selected such that the wall of vertical member 120 adjacent frame 30 and the retainer 130 serve to grip with a snug or running/locking fit the front and back walls of frame 30. Once the user has selected a vertical position for rigid support frame 22, the pressure exerted by the back of the user on frame 30 will aid in retaining support frame 22 in the selected vertical position.

Each vertical adjustment member 124 preferably comprises a pair of connecting arms 125. The first end of each connecting arm 125 are spaced apart where they connect to vertical member 120. The second ends of each connecting arm 125 converge to provide a mounting for the control handle 67. This configuration provides a strong and stable connection between the control handle 67 and the vertical members 120 of rigid support frame 22. Further, the vertical force applied to handle 67 is transmitted to both the upper and lower sections of frame 22 thus assisting in providing smoother movement of tongues 126 in channels 32, 34, 36 and 38.

In this preferred embodiment, a cable is again tensioned to adjust the amount of lumbar support which is provided to the user. In this embodiment, tensioning the cable causes hinged plate 158 to force flexible plate 20 outwardly as opposed to compressing the opposed horizontal ends of flexible plate together as per the preferred embodiment of FIGS. 2–6. As shown in FIG. 11, tension adjustment mechanism 132 comprises sheathed cable 110, hand actuated knob 82, worm gear 134, gear 136, and housing 138 (FIG. 10). Worm gear 134 is drivenly rotatably mounted to hand actuated knob 82 and engages the teeth of gear 136. Sheathed cable 110 comprises, in the preferred embodiment, an internal cable 112 which is slidably contained within a protective sleeve. Sheathed cable 110 is commonly known in the art as a Bowden cable. Thus, as hand actuated knob 82 is rotated by the user, the internal cable 112 is either wound or unwound around shaft 140. Shaft 140 (eg. the take up spool) is affixed to gear 136 and has an associated retaining block 142 which retains first fixed cable end 114.

Housing 138 provides a structure to contain hand actuated knob 82, worm gear 134 and gear 136. Housing 138 may serve to ensure worm gear 134 and gear 136 are maintained in constant contact. The end of worm gear 134 distal to hand actuated knob 82 is retained in housing 138 by stop 144. Stop 144 is connected at one end to housing 138 and contains a central opening which receives a shaft extension 146 located on the axis of rotation of worm gear 134.

Shaft 140 may be connected to frame 30 and/or housing 138 by any means known in the art to support shaft 140 and to allow shaft 140 to rotate freely with minimal wear for extended use. Such connections may include a low friction fit or bearing fittings.

Figure 13:
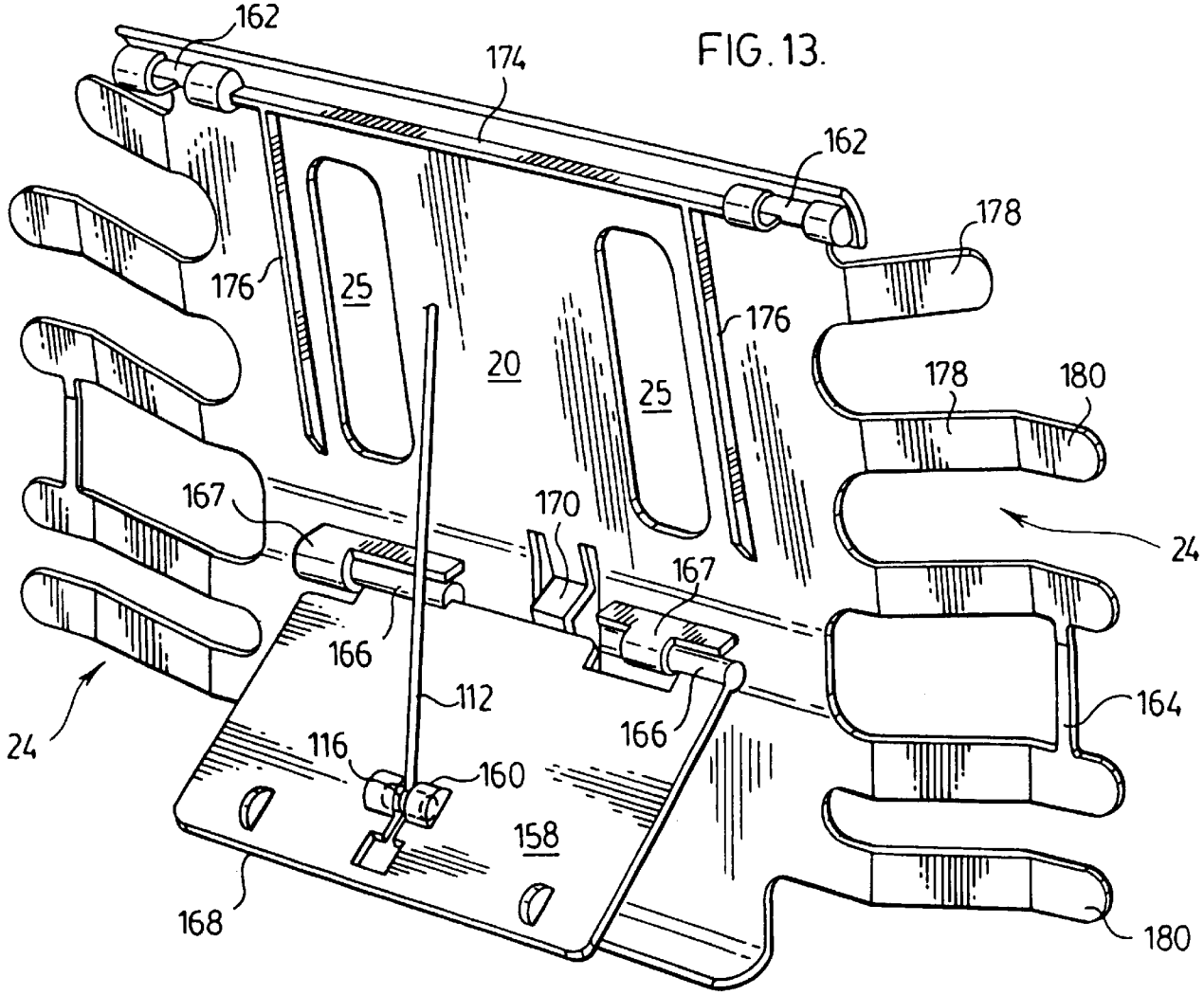

One end of sheathed cable 110 is affixed to frame 30 by cable receptacle 148. Cable receptacle 148 serves to retain the exterior of sheathed cable 110 in a fixed position so that inner cable 112 may move within sheathed cable 110 as shaft 140 is rotated. Cable receptacle 148 is affixed to frame 30 by any means known in the art, such as by moulding to be integral to frame 30. The other end of sheathed cable 110 is affixed to support frame 22 (or flexible plate 20) by cable retainer 150. Extending from cable retainer 150, the internal cable 112 is affixed at second fixed cable end 116 to hinged plate 158 by plate retainer 160 (FIGS. 12 and 13). Cable retainer 150 may be mounted on flange 152 which is in turn attached to horizontal member 122. Cable retainer 150 projects into vertical slot 154 so that as the user moves support frame 22 up or down, cable retainer 150 slides within vertical slot 154.

Referring now to FIGS. 12 and 13, support frame 22 has retainers 130 attached to tongues 126, the tongues 126 being preferably located at or towards the top and bottom ends of vertical members 120. Retainers 130 connected at the top end of vertical members 120 in combination with retention receptacles 162 detachably connect flexible support 20 to support frame 22. This combination of retainers 130 and retention receptacles 162 provides for rotational movement of the retainers 130 within the retention receptacles 162 while maintaining a solid connection between flexible support 20 and support frame 22. The connection of retainers 130 to retention receptacles 162 and thus the horizontal rigidity of flexible support 20 at its top may be reinforced by providing a horizontal rib 174 on the back face of flexible support 20 between the retention receptacles 162. Additional reinforcement of flexible support 20 may be provided by a pair of vertical ribs 176 each extending from a point near the end of the horizontal rib 174. The ribs 176 extend, eg., to the mid region of flexible support 20 and thus do not interfere with the flexing of support 20 in the area that is in contact with the lordosis region of the user's back.

Retainers 130 located at the bottom end of vertical members 120 are not directly connected to flexible support frame 20 and simply slide within lower vertical aligned channels 36 and 38.

Flexible support 20 may be solid or may contain a plurality of support fingers 24 and holes or gaps 25. The gaps 25 serve to improve the flexibility of the flexible support 20 in the longitudinal direction and thus aid in the wrapping of the support fingers 24 about the back of the user. The support fingers 24 may be shaped to better accommodate the shape of a human back, as is known in the art. As shown in FIG. 12 the support fingers 24 are of varying lengths, the longer fingers being sized to wrap around the lordosis region of the lower back as the user presses their back into the central region of the flexible support 20. In the illustrated embodiment, support fingers 24 have a first portion 178 and optional second portion 180. First portion 178 extends at an acute angle from the vertical edge of the main body portion of flexible support 20 such that they extend toward the back of the user. Optional portion 180 does not continue on the same plane as first portion 178 but rather is an extension of first portion 178 that may be parallel to the surface of flexible support 20.

Between fingers 24 may be provided a vertical web 164 which serves to allow support fingers 24 to provide a more rigid support. As shown in FIG. 13 vertical web 164 connects at least two fingers together. The connection may be adjacent second portions 180. The vertical web 164 may, however, connect the fingers 24 at any point.

Referring now to FIG. 13, affixed between flexible support 20 and frame 30 is a rigid hinged plate 158. Hinged plate 158 is pivotally attached to the rear face of flexible support 20 by, eg., hinge pins 166 and hinges 167. Hinge pins 166 may be constructed so that they are an integral part of hinged plate 158. Similarly hinges 167 may be an integral part of flexible support 20. In assembly, hinge pins 166 easily slip into hinges 167.

As the user rotates hand actuated knob 82, cable 112 is wound or unwound around spool 140 (FIG. 11). As the cable 112 is wound around spool 140, the cable 112 pulls leading edge 168 of hinged plate 158 upwardly thus forcing leading edge 168 of the hinged plate 158 into contact with frame 30. Frame 30 and hinged plate 158 are both rigid compared to flexible support 20. Thus the upward movement of leading edge 168 causes flexible support 20 to convexly bend into the back of the user. To decrease the amount of projection of flexible support 20 into their back, the user rotates hand actuated knob 82 in the opposite direction to unwind cable 112 from spool 140. This reduces the tension in cable 112 and permits leading edge 168 of hinged plate 158 to descend vertically along frame 30. This vertical descent may be aided by plate spring 170 which biases hinged plate 158 toward its vertical position. Plate spring 170 may be integrally formed with flexible support 20 so that it contacts the top edge of hinged plate 158, near the centre line of hinged plate 158.

In the preferred embodiment the flexible support 20, rigid support frame 22 and hinged plate 158 are each manufactured from moulded plastic as separate pieces that easily connect to each other.

While preferred embodiments of the present invention have been described, the embodiments disclosed are illustrative and not restrictive, and the scope of the invention is intended to be defined only by the appended claims.

We claim:

1. A chair back comprising:

(a) a rear surface, a front surface spaced from the rear surface and a side extending between the front and rear surfaces;

(b) a lumbar support member positioned between the front and rear surfaces;

(c) a horizontal position adjustment member fixedly positioned on a rearwardly facing portion of the rear surface for adjusting the amount of support provided by the lumbar support member;

(d) a height adjustment member positioned adjacent at least one side for adjusting the vertical height of the lumbar support member;

(e) a first controller drivingly connected to the horizontal position adjustment member; and, (f) a second controller drivingly connected to the height adjustment member.

2. The chair back as claimed in claim 1 wherein the first controller is positioned on the rear surface of the chair back.

3. The chair back as claimed in claim 1 wherein the side has a longitudinally extending opening, the second controller extending through the opening to the lumbar support member and travelling along the opening as the height of the lumbar support member is adjusted.

4. The chair back as claimed in claim 1 wherein the height adjustment member comprises a longitudinally extending track on which the lumbar support member is longitudinally moveable and friction elements which maintain the lumbar support member in position on the track.

5. The chair back as claimed in claim 4 wherein the chair back includes a frame and the track comprises at least one opening in the frame, the opening having a side wall defining the outer perimeter of the opening, and the friction elements releasably engages the side wall of the opening.

6. The chair back as claimed in claim 5 wherein the height adjustment member has at least one runner which travels in the track, the side walls of the track being spaced apart at a plurality of discrete locations by a distance less than the thickness of the runner to frictionally engage the runner to hold the lumbar support member in position with respect to the chair back.

7. The chair back as claimed in claim 4 wherein the chair back includes a frame having a front face and a rear face and the track comprises at least one opening in the frame, the height adjustment member comprises a frame member positioned on the rear face of the frame and at least one runner which extends through the frame to engage the lumbar support member positioned on the front face of the frame, the at least one runner having a length sufficiently small to cause a portion of the lumbar support member and the frame member to engage the frame.

8. The chair back as claimed in claim 1 wherein the horizontal position adjustment member includes a tensionable cable.

9. The chair back as claimed in claim 8 wherein the lumbar support member comprises a compressible member affixed to one end of the cable, the compressible member extending forwardly when the cable is tensioned.

10. The chair back as claimed in claim 9 wherein the compressible member comprises a flexible panel having an upper end and a lower end and the first controller comprises a rotatable knob whereby rotation of the knob tensions the cable and causes at least one of the upper and lower ends of the flexible panel to move towards the other such that the panel bows forwardly.

11. The chair back as claimed in claim 10 wherein the chair back further comprises a frame and the horizontal position adjustment member further comprises an arm member pivotally mounted on the frame, a first arm of the arm member being connected to the cable and a second arm extending to contact the first controller, the first controller including a member mounted for transverse movement whereby transverse movement of the member in one direction causes the second arm to move transversely and the first arm to move vertically to compress and bow the flexible panel.

12. The chair back as claimed in claim 9 wherein the chair back further comprises a frame, the compressible member comprises a panel positioned in front of the frame and a deflecting member positioned between the frame and the panel, the deflecting member affixed to one end of the cable, at least a portion of the deflecting member moveable with the cable whereby tensioning of the cable adjusts the position of the deflecting member to move a portion of the panel outwardly.

13. The chair back as claimed in claim 12 wherein the deflecting member is affixed to the rear surface of the panel and the first controller comprises a rotatable knob.

14. A height adjustment mechanism for a lumbar support for a seat back comprising a rigid support member for the seat back, the rigid support member having two longitudinally extending tracks each comprising an opening in the rigid support member, each track having at least one associated first engagement member comprising a narrowed portion of the opening, the lumbar support member having at least one second engagement member mounted on each track and longitudinally moveable thereon to adjust the position of the lumbar support member with respect to the chair back, each at least one second engagement member engaging the at least one first engagement member of the respective track to maintain the lumbar support member in position on the track, the lumbar support member having manual adjustment members extending laterally outwardly therefrom.

15. The height adjustment mechanism as claimed in claim 14 wherein the first engagement members are provided at discrete locations along the tracks.

16. The height adjustment mechanism as claimed in claim 15 wherein the at least one second engagement member releasably engages at least one of the first engagement members as the lumbar support member moves longitudinally along the tracks.

17. The height adjustment mechanism as claimed in claim 14 wherein the rigid support member has a front face and a rear face and the tracks comprise at least one opening in the rigid support member, the height adjustment mechanism further comprises a frame member positioned on the rear face of the rigid support member and at least one runner which extends through the rigid support member to engage the lumbar support member positioned on the front face of the rigid support member, the at least one runner having a length sufficiently small to cause a portion of the lumbar support member and the rigid support member to engage the frame member whereby the portion of the lumbar support member and the rigid support member comprise friction elements.

18. A lumbar adjustment mechanism which is mounted in a seat back having a frame and a rear surface and adjusts the amount of support provided by a lumbar support comprising:

(a) a lumbar support member;

(b) a controller mounted on the rear surface of the seat back when the lumbar adjustment mechanism is mounted in the seat back; and, (c) a cable having a first end connected to the lumbar support member and a second end to the controller whereby adjustment of the controller tensions the cable and adjusts the amount of lumbar support which is provided.

19. The lumbar adjustment mechanism as claimed in claim 18, wherein the lumbar support member comprises a compressible member affixed to one end of the cable, the compressible member extending forwardly when the cable is tensioned.

20. The lumbar adjustment mechanism as claimed in claim 19, wherein the compressible member comprises a flexible panel having an upper end and a lower end and the controller comprises a rotatable knob whereby rotation of the knob tensions the cable and causes at least one of the upper and lower ends of the flexible panel to move towards the other such that the panel bows forwardly.

21. The lumbar adjustment mechanism as claimed in claim 20 further comprising an arm member pivotally mountable on the frame, a first arm of the arm member being connected to the cable and a second arm extending to contact the controller, the controller including a member mounted for transverse movement whereby transverse movement of the member in one direction causes the second arm to move transversely and the first arm to move vertically to compress and bow the flexible panel.

22. The lumbar adjustment mechanism as claimed in claim 19 wherein the compressible member comprises a panel positioned in front of the frame and a deflecting member positioned between the frame and the panel, the deflecting member affixed to one end of the cable, at least a portion of the deflecting member moveable with the cable whereby tensioning of the cable causes adjusts the position of the deflecting member to move a portion of the panel outwardly.

23. The lumbar adjustment mechanism as claimed in claim 22 wherein the deflecting member is affixed to the rear surface of the panel and the controller comprises a rotatable knob.

24. A chair back comprising:

(a) a rear surface, a front surface spaced from the rear surface and a side extending between the front and rear surfaces;

(b) a lumbar support member positioned between the front and rear surfaces;

(c) horizontal position adjustment means fixedly positioned on a rearwardly facing portion of the rear surface for adjusting the amount of support provided by the lumbar support member;

(d) height adjustment means positioned adjacent at least one side for adjusting the vertical height of the lumbar support member;

(e) a first control means drivingly connected to the horizontal position adjustment means; and, (f) a second control means drivingly connected to the height adjustment means.

25. The chair back as claimed in claim 24 wherein the first control means is positioned on the rear surface of the chair back.

26. The chair back as claimed in claim 24 wherein the side has a longitudinally extending opening, the second control means extending through the opening to the lumbar support member and travelling along the opening as the height of the lumbar support member is adjusted.

27. The chair back as claimed in claim 24 wherein the height adjustment member comprises a longitudinally extending track on which the lumbar support member is longitudinally moveable and friction means to maintain the lumbar support member in position on the track.

28. The chair back as claimed in claim 24 wherein the lumbar support member has a front surface and the horizontal position adjustment means includes a cable, means for tensioning the cable and means for moving at least a portion of the front surface outwardly as the cable is tensioned.

29. The chair back as claimed in claim 28 wherein the means for moving at least a portion of the front surface outwardly as the cable is tensioned comprises means for compressing the lumbar support member.

30. The chair back as claimed in claim 28 wherein the chair back has a frame and the means for moving at least a portion of the front surface outwardly as the cable is tensioned comprises a moveable member positioned between the frame and the lumbar support member whereby tensioning of the cable adjusts the position of the moveable member to move a portion of the lumbar support member outwardly.

31. A height adjustment mechanism for a lumbar support for a seat back comprising a rigid support member for the seat back, the rigid support member having two track means, the track means having associated first engagement means comprising restrictions in the track means the lumbar support member having second engagement means mounted on each track means and longitudinally moveable thereon to adjust the height of the lumbar support member with respect to the chair back, and the second engagement means engaging the first engagement means of the respective track to maintain the lumbar support member in position on the track means, the lumbar support member having manual adjustment means extending laterally outwardly therefrom.

32. The height adjustment mechanism as claimed in claim 31 wherein the first engagement means are provided at discrete locations along the track means.

33. The height adjustment mechanism as claimed in claim 31 wherein the second engagement means releasably engages the first engagement means as the lumbar support member moves longitudinally along the track means.

34. A lumbar adjustment mechanism which is mounted in a seat back having a frame and a rear surface and adjusts the amount of support provided by a lumbar support comprising:

(a) a lumbar support member;

(b) a controller mounted on the rear surface of the seat back when the lumbar adjustment mechanism is mounted in the seat back;

(c) a cable having a first end connected to the lumbar support member and a second end to the controller; and, tension means to tension the cable; whereby adjustment of the tension means tensions the cable and adjusts the amount of lumbar support which is provided.

35. The lumbar adjustment mechanism as claimed in claim 34 wherein the lumbar support member has a front surface and the lumbar adjustment mechanism includes means for moving at least a portion of the front surface outwardly as the cable is tensioned.

36. The lumbar adjustment mechanism as claimed in claim 35 wherein the means for moving at least a portion of the front surface outwardly as the cable is tensioned comprises means for compressing the lumbar support member.

37. The lumbar adjustment mechanism as claimed in claim 35 wherein the means for moving at least a portion of the front surface outwardly as the cable is tensioned comprises a moveable member positioned between the frame and the lumbar support member whereby tensioning of the cable adjusts the position of the moveable member to move a portion of the lumbar support member outwardly.

* * * * *